US008519804B2

(12) United States Patent
Takeuchi et al.

(10) Patent No.: US 8,519,804 B2
(45) Date of Patent: Aug. 27, 2013

(54) WIRED TRANSMISSION LINE FOR ELECTROMAGNETIC COUPLING OF FIRST AND SECOND MILLIMETER WAVE AV DEVICES

(75) Inventors: Futoshi Takeuchi, Tokyo (JP); Rikiya Ishikawa, Kanagawa (JP); Kenichi Kawasaki, Tokyo (JP)

(73) Assignee: Sony Corporation (JP)

( * ) Notice: Subject to any disclaimer, the term of this patent is extended or adjusted under 35 U.S.C. 154(b) by 403 days.

(21) Appl. No.: 12/804,423

(22) Filed: Jul. 21, 2010

(65) Prior Publication Data

US 2011/0047588 A1 Feb. 24, 2011

(30) Foreign Application Priority Data

Aug. 21, 2009 (JP) ..... P2009-192401

(51) Int. Cl.
*H01P 5/02* (2006.01)

(52) U.S. Cl.
USPC ..... 333/24 R; 333/248

(58) Field of Classification Search
USPC ..... 333/24 R, 248, 254, 239, 243, 245, 333/157
See application file for complete search history.

(56) References Cited

U.S. PATENT DOCUMENTS

| | | | | |
|---|---|---|---|---|
| 2,436,421 | A * | 2/1948 | Cork | 138/125 |
| 2,479,288 | A * | 8/1949 | Allen | 138/139 |
| 4,785,268 | A * | 11/1988 | Walter et al. | 333/157 |
| 5,929,718 | A * | 7/1999 | Crosby | 333/24 R |
| 6,590,477 | B1 * | 7/2003 | Elco | 333/239 |
| 7,301,424 | B2 * | 11/2007 | Suarez-Gartner et al. | 333/239 |

FOREIGN PATENT DOCUMENTS

| | | | |
|---|---|---|---|
| DE | 4305009 | C1 | 6/1994 |
| EP | 1939986 | A2 | 7/2008 |
| JP | 2008028549 | A | 2/2008 |
| JP | 2008-252566 | A | 10/2008 |
| WO | 02091616 | A2 | 11/2002 |
| WO | 2008015371 | A1 | 2/2008 |

OTHER PUBLICATIONS

European Search Report EP 10172699, dated Dec. 6, 2010.

* cited by examiner

*Primary Examiner* — Benny Lee
(74) *Attorney, Agent, or Firm* — Lerner, David, Littenburg, Krumholz & Mentlik, LLP

(57) ABSTRACT

There is provided a wired transmission line for AV devices which includes a first AV device and a second AV device, the wired transmission line allowing millimeter-wave communication between the first AV device and the second AV device using a millimeter-wave communication module provided for each of the first AV device and the second AV device, wherein the wired transmission line includes: a first coupling unit capable of being attached to a housing of the first AV device above the millimeter-wave communication module included in the first AV device; a second coupling unit capable of being attached to a housing of the second AV device above the millimeter-wave communication module included in the second AV device; and a waveguide which couples the first coupling unit and the second coupling unit.

9 Claims, 7 Drawing Sheets

WIRED TRANSMISSION LINE FOR ELECTROMAGNETIC COUPLING OF FIRST AND SECOND MILLIMETER WAVE AV DEVICES

CROSS-REFERENCE TO RELATED APPLICATION

The present application claims priority from Japanese Patent Application No. JP 2009-192401 filed in the Japanese Patent Office on Aug. 21, 2009, the entire content of which is incorporated herein by reference.

BACKGROUND OF THE INVENTION

1. Field of the Invention

The present invention relates to a wired transmission line for AV devices. More specifically, the present invention relates to a wired transmission line used for AV devices having a millimeter-wave communication function.

2. Description of the Related Art

In recent years, a wired transmission system which transmits and receives uncompressed video data and uncompressed audio data (hereinafter also referred to as audio visual (AV) data) between high-definition multimedia interface (HDMI)-connected devices has been put to practical use.

Further, based on digital living network alliance (DLNA: registered trademark) technical specifications, communication of AV data between devices using a home LAN (home network) in particular has also been performed. Further, there is also an increasing demand for downloading the AV data onto a portable device at high speed.

Millimeter-wave communication capable of performing Gbps-order transmission has received attention in order to transmit AV data at high speed under these circumstances.

Then, an audio and visual device (hereinafter also referred to as an AV device) which includes a millimeter-wave communication module and is premised on millimeter-wave wireless AV data transmission has been proposed.

However, it is difficult for the AV device capable of millimeter-wave wireless AV data transmission to ensure a stable communication path when a wireless communication path in a free space from a transmission portion to a reception portion cannot be ensured due to a surrounding environment or a condition in which the AV device is installed, or because of interference among a plurality of similar devices which use millimeter-wave wireless AV data transmission. In such a case, AV data transmission may not be performed.

When the wireless communication path cannot be ensured in the free space, there is provided a method of switching connection between an antenna and a transmitter/receiver to wired connection using a millimeter-wave waveguide such as a coaxial line to ensure the communication path. Alternatively, there is also provided a method of switching an output destination of a video signal inside the AV device from a radio transmitter/receiver to a wired transmission system using an HDMI cable, for use, for example.

Japanese Patent Application JP 2008-252566, for example, proposes a method of stacking a plurality of AV devices one atop another, installing the stacked AV devices, and changing a radiation direction of a millimeter wave to allow communication even if the millimeter-wave transmission/reception unit of an AV device is shielded by an electromagnetic wave shielding object. This method has been proposed to deal with shielding of an antenna opening surface.

SUMMARY OF THE INVENTION

However, when wireless connection between the antenna and the transmitter/receiver is switched to wired connection using the waveguide such as the coaxial line, it is necessary to provide a mechanism capable of switching a connecting destination between the waveguide and the antenna at a millimeter-wave communication module in advance. However, the millimeter wave has a large space attenuation. Thus, it is necessary to sharpen directivity of the antenna and set a large gain. However, even if the antenna has sharp directivity, it is necessary to allow easy installation of the AV device and accommodate a change in a propagation environment such as when a moves in a room. Thus, preferably, the directivity is variable. In order to satisfy one or both of these demands, an array antenna is generally employed for the millimeter-wave communication module. On contrast with the array antenna constituted from a plurality of antennas, the mechanism which simply switches connection to one waveguide becomes very complicated, leading to an increase in the cost of the module. Further, addition of the switching mechanism brings about an increase in signal loss, leading to performance deterioration when a usual antenna is employed.

In the method of ensuring the AV data transmission line by employing a different wired transmission system using the HDMI cable or the like, it is necessary to add to the AV device not only the millimeter-wave communication module but also an HDMI transmitter, an HDMI receiver, and a component which switches the video signal inside the AV device. This leads to an increase in the cost.

In view of the above-mentioned issues, the present invention provides a wired transmission line for AV devices which allows millimeter-wave communication between the AV devices even when it is difficult to ensure a millimeter-wave communication path in a free space.

According to an embodiment of the present invention, there is provided a wired transmission line for AV devices which includes a first AV device and a second AV device, the wired transmission line allowing millimeter-wave communication between the first AV device and the second AV device using a millimeter-wave communication module provided for each of the first AV device and the second AV device, wherein the wired transmission line includes: a first coupling unit capable of being attached to a housing of the first AV device above the millimeter-wave communication module included in the first AV device; a second coupling unit capable of being attached to a housing of the second AV device above the millimeter-wave communication module included in the second AV device; and a waveguide which couples the first coupling unit and the second coupling unit.

With this arrangement, the first coupling unit and the second coupling unit are respectively attached to the housings of the first AV device and the second AV device above the millimeter-wave communication module included in the first AV device and the millimeter-wave communication module included in the second AV device. Then, the first coupling unit and the second coupling unit are coupled by the waveguide. This allows stable communication between the AV devices using the wired transmission line even when it is difficult to ensure a millimeter-wave communication path in a free space.

Each of the first coupling unit and the second coupling unit may be shaped like a horn antenna; a first conversion unit which converts a mode of a millimeter wave is provided at a coupling portion between the first coupling unit and the waveguide; and a second conversion unit which converts the mode of the millimeter wave may be provided at a coupling portion between the second coupling unit and the waveguide.

Each of the first coupling unit and the second coupling unit may be shaped like a box; the waveguide may have a rectangular section; and one or more slots may be provided in a coupling portion between the first coupling unit and the waveguide and a coupling portion between the second coupling unit and the waveguide.

The waveguide may be a coaxial line in which an internal conductor and an external conductor are concentrically disposed, and the external conductor may have a shape of a mesh-braided conductor.

The internal conductor at one end portion of the coaxial line may project into an internal space of the first coupling unit at a coupling portion between the first coupling unit and the coaxial line; and the internal conductor at the other end portion of the coaxial line may project into an internal space of the second coupling unit at a coupling portion between the second coupling unit and the coaxial line.

The waveguide may have a configuration in which a cylindrical dielectric is covered with a mesh-braded conductor.

The waveguide may have an annular metal member.

The waveguide may be a rectangular waveguide formed of a metal member.

The waveguide has a configuration of a coaxial line in which an external conductor may be a mesh-braided conductor or a configuration in which a cylindrical dielectric may be covered with a mesh-braided conductor, and the waveguide may couple the first coupling unit and the second coupling unit while a part of the waveguide being bent.

The first coupling unit and the second coupling unit may be respectively attached to the housings of the first AV device and the second AV device so as to overhang the millimeter-wave communication modules.

According to another embodiment of the present invention, there is provided a wired transmission method for AV devices comprising a first AV device, a second AV device, and a wired transmission line to perform millimeter-wave communication using a millimeter-wave communication module provided for each of the first AV device and the second AV device through the wired transmission line, the wired transmission method which includes the steps of: sending out a millimeter wave from the millimeter-wave communication module of the first AV device to a first coupling unit attached to a housing of the first AV device above the millimeter-wave communication module of the first AV device; transmitting the millimeter wave from the first coupling unit to a waveguide coupled to the first coupling unit; and transmitting the millimeter wave from the waveguide coupled to a second coupling unit to the second coupling unit attached to a housing of the second AV device above the millimeter-wave communication module of the second AV device.

As described above, according to the present invention, even when it is difficult to ensure the millimeter-wave communication path in the free space, there may be provided the wired transmission line for AV devices which allows millimeter-wave communication between the AV devices.

DETAILED DESCRIPTION OF THE EMBODIMENTS

Figure 1:
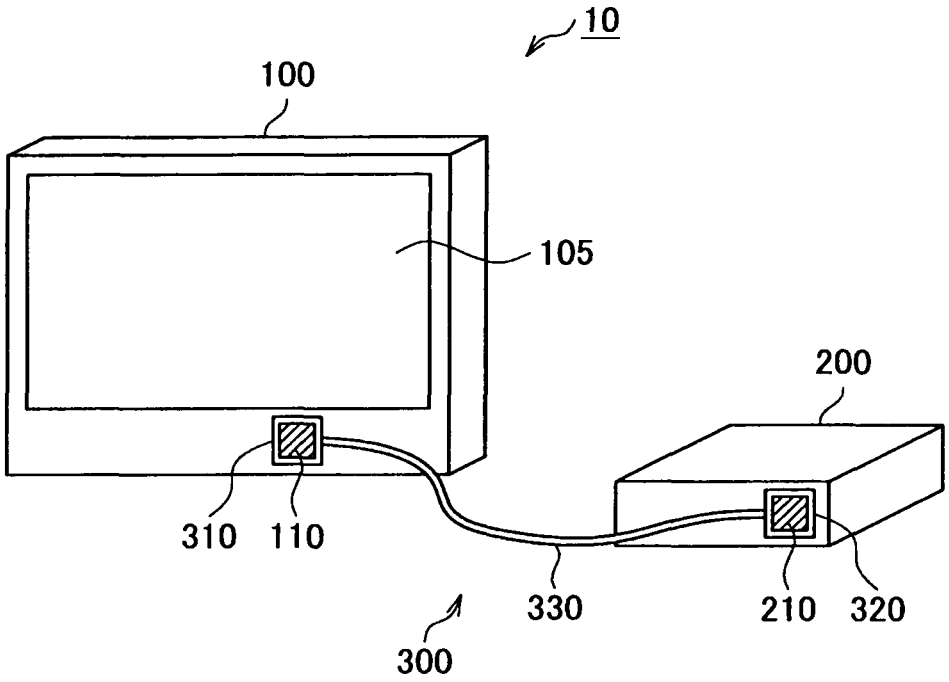
FIG. 1 is a diagram showing an overall configuration of AV devices according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

An embodiment and variation examples of the present invention will be described in the following order.

<1. First Embodiment>
[1-1. Overall Configuration of AV Devices]
[1-2. Hardware Configuration of Coupling Unit]
[1-3. Hardware Configuration of Waveguide]
[1-4. Internal Configurations and Operations of Monitor Unit and Set-Top Box]
<2. Variation Example: Coupling Unit>
[2-1. First Variation Example of Coupling Unit]
[2-2. Second Variation Example of Coupling Unit]
<3. Variation Example: Waveguide>
[3-1. Third Variation Example of Waveguide]
[3-2. Fourth Variation Example of Waveguide]
[3-3. Fifth Variation Example of Waveguide]

1. First Embodiment

[1-1. Overall Configuration of AV Devices]

First, an overall configuration of AV devices according to a first embodiment of the present invention will be described with reference to FIG. 1. In this embodiment, a separate-type TV set will be described, as an example. A TV set 10 as the AV devices in this embodiment includes a monitor unit 100 and a set-top box 200.

The monitor unit 100 displays video on a display 105 so that a user may view and listen to the video. The monitor unit 100 outputs voice from a loudspeaker not shown. The monitor unit 100 includes a millimeter-wave communication module 110.

Figure 10:
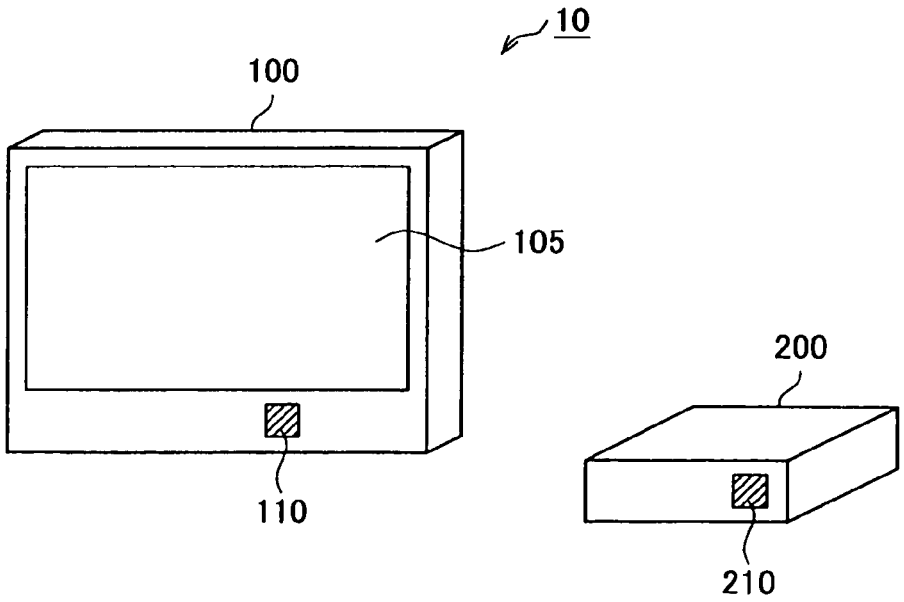
FIG. 10 is a diagram showing an overall configuration of the AV devices to which a wired transmission line is not attached in the first embodiment of the present invention.

The set-top box 200 includes an input terminal for receiving a video signal and an audio signal from outside of the box 200, a tuner for receiving a broadcasting wave, a millimeter-wave communication module 210, and the like. Each of the millimeter-wave communication modules 110 and 210 allows millimeter-wave wireless transmission in free space. Accordingly, as shown in FIG. 10, the TV set 10 in this embodiment sends out AV data (video data and audio data) from the set-top box 200 to the monitor unit 100 by the millimeter-wave wireless communication using functions of the millimeter-wave communication modules 110 and 210 when an acceptable electric wave condition exists. The monitor unit 100 is an example of a first AV device, while the set-top box 200 is an example of a second AV device.

However, a millimeter-wave wireless communication path may not be able to be ensured in free space, depending on a surrounding environment. When the set-top box 200 is installed in a metal rack and the millimeter-wave transmission line from the set-top box 200 to the monitor unit 100 is blocked, AV data cannot be transmitted.

Assume that the number of frequency channels is limited. Then, when a plurality of devices, the number of which exceeds the number of channels, are operated around the TV set 10 or when a device that utilizes the millimeter-wave wireless communication using the same band is present in the vicinity of the TV set 10, AV data cannot be transmitted, or interference may be caused for the device in the vicinity of the TV set 10, which utilizes the millimeter-wave wireless communication.

Even in the case as described above where it is difficult to ensure that the millimeter-wave communication path in free space, this embodiment provides a wired connection configuration including a auxiliary function which allows millimeter-wave communication between the AV devices that constitute the TV set 10.

That is, in this embodiment as shown in FIG. 1, a wired transmission line 300 for the AV devices is installed between the monitor unit 100 and the set-top box 200, as this wired connection feature. The wired transmission line 300 includes a first coupling unit 310, a second coupling unit 320, and a waveguide 330.

The first coupling unit 310 is a member capable of being attached to the housing of the monitor unit 100 above the millimeter-wave communication module 110 of the monitor unit 100. The second coupling unit 320 is a member capable of being attached to the housing of the set-top box 200 above the millimeter-wave communication module 210 of the set-top box 200. The waveguide 330 is a wired transmission line which couples the first coupling unit 310 and the second coupling unit 320. A hardware configuration of each unit will be described below.

[1-2. Hardware Configuration of Coupling Unit]

The first coupling unit 310 and the second coupling unit 320 in this embodiment are basically configured to have a same shape. The first coupling unit 310 and the second coupling unit 320 are coupled to the waveguide 330 at respective terminating ends of the waveguide 330. Accordingly, a hardware configuration of the first coupling unit 310 will be described with reference to FIG. 2, and description of a hardware configuration of the second coupling unit 320 will be omitted. The configurations of the first coupling unit 310 and the second coupling unit 320 may be of course obtained by combining configurations of the coupling unit in the embodiment and a coupling unit in each variation example, which will be described below.

Figure 2:
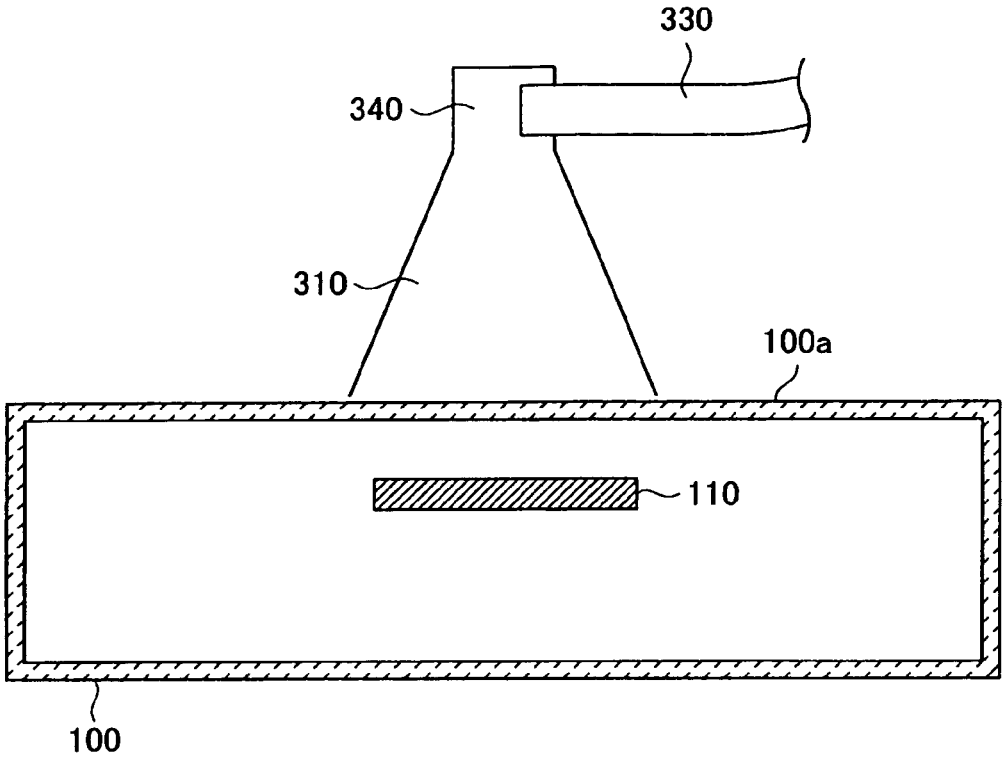
FIG. 2 is a diagram showing a hardware configuration of a coupling unit in the first embodiment.

FIG. 2 shows the front portion of the monitor unit 100 in FIG. 1. The first coupling portion 310 is attached to an exterior resin 100*a* of the housing of the monitor unit 100 immediately above the millimeter-wave communication module 110. The first coupling unit 310 is a conductor having a hollow shape which extends in the form of a trumpet or a horn toward a leading end portion thereof. The leading end portion of the first coupling unit 310 opens. At the root of the first coupling unit 310, a first conversion unit 340 which couples the first coupling unit 310 and the waveguide 330 and converts the mode of a millimeter wave is provided.

As described above, the first coupling unit 310 is formed in the shape of a horn antenna and is attached to the exterior resin 100*a* of the housing which constitutes the monitor unit 100 in such a manner that the first coupling unit 310 overhangs an outside surface of the millimeter-wave communication module 110.

In the case of the second coupling unit 320 as well, a second conversion unit which converts the mode of the millimeter wave is provided at a portion that couples the second coupling unit 320 and the waveguide 330.

[1-3. Hardware Configuration of Waveguide]

Figure 3:
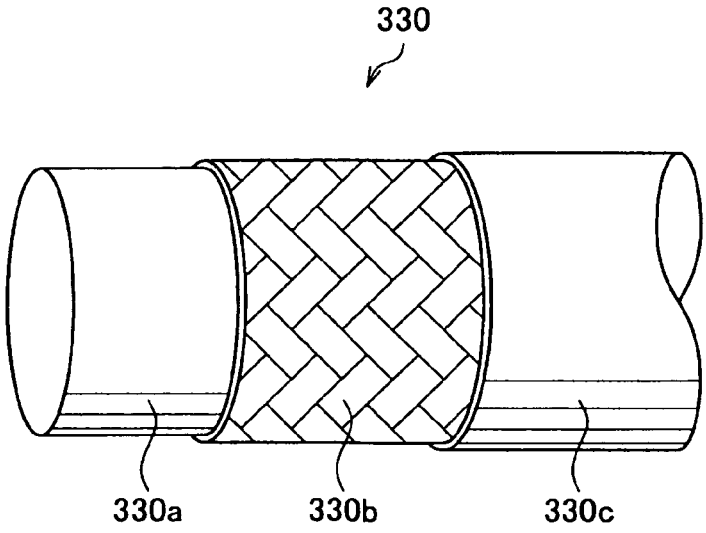
FIG. 3 is a diagram showing a hardware configuration of a waveguide in the first embodiment.

Next, a hardware configuration of the waveguide 330 according to this embodiment will be described with reference to FIG. 3. In the waveguide 330, a cylindrical dielectric 330*a* is covered with a mesh-braided conductor 330*b*, and an outermost layer of the waveguide is covered with a protective film 330*c*. There is scarcely leakage of the millimeter wave outside of the waveguide 330, and bending of the waveguide 330 to a certain degree is possible. The waveguide 330 does not necessarily have to be cylindrical, and may be rectangular, for example.

[1-4. Operation of Wired Transmission Line]

Figure 4:
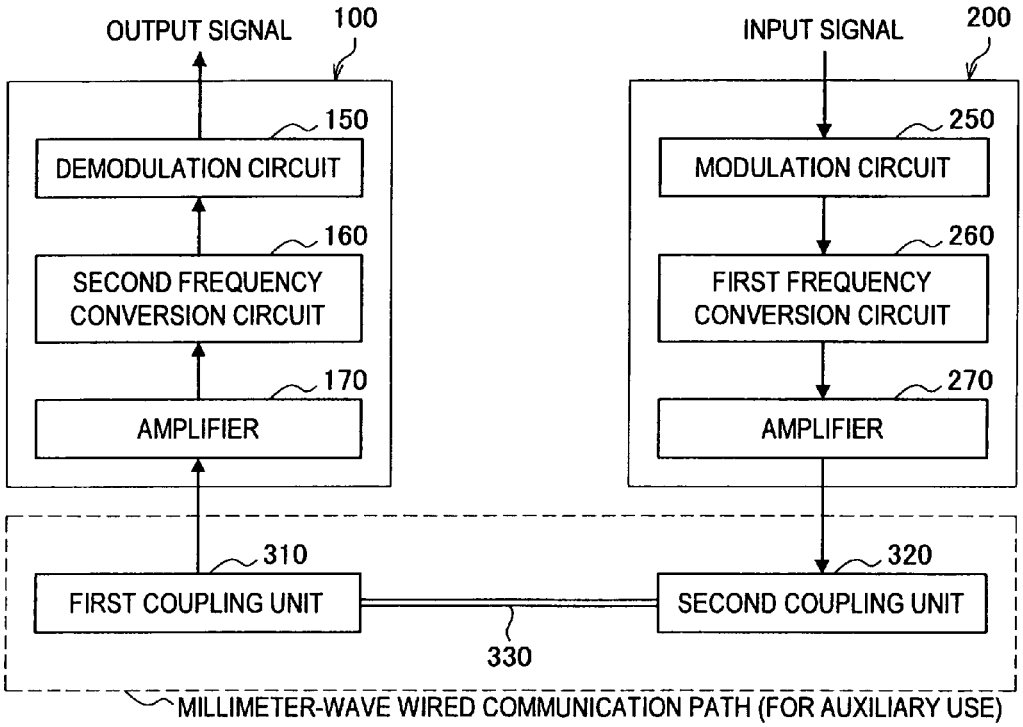
FIG. 4 is a diagram for explaining internal configurations and operations of the AV devices in the first embodiment.
Figure 11:
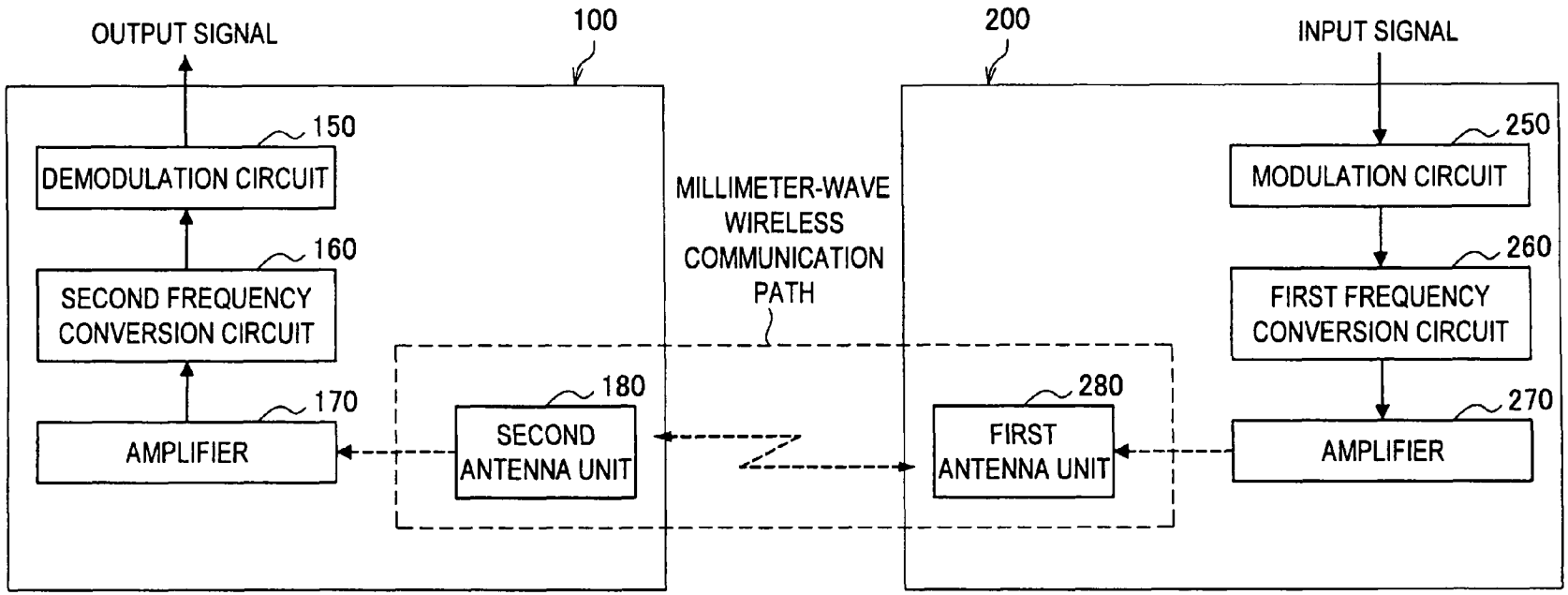
FIG. 11 is a diagram for explaining internal configurations and operations of the AV devices shown in FIG. 10.

Next, an operation in which millimeter-wave communication is performed using the wired transmission line 300 for the AV devices according to this embodiment will be described while comparing with an operation in which millimeter-wave wireless communication is performed without using the wired transmission line or millimeter-wave wired communication path 300 for the AV devices. FIGS. 1 and 4 show configurations and the operation when the millimeter-wave communication is performed using the wired transmission line 300 for the AV devices. The use of the wired transmission line may be considered an auxiliary use. FIGS. 10 and 11 show configurations and the operation when the millimeter-wave wireless communication is performed without using the wired transmission line 300 for the AV devices.

(Millimeter-wave Wireless Communication)

When a communication environment is good, video data and audio data are transmitted from the set-top box 200 to the monitor unit 100 by the millimeter-wave wireless communication, without using the wired transmission line 300 for the AV devices, as shown in FIGS. 10 and 11.

As shown in FIG. 11, the set-top box 200 includes a modulation circuit 250, a first frequency conversion circuit 260, an amplifier 270, and a first antenna unit 280. In the modulation circuit 250 and the first frequency conversion circuit 260, a millimeter-wave signal is generated. That is, when an input signal is supplied to the modulation circuit 250, the modulation circuit 250 modulates the received input signal. The modulated signal is frequency-converted by the first frequency conversion circuit 260 connected to the modulation circuit 250, thereby generating the millimeter-wave signal. The millimeter-wave signal is amplified by the amplifier 270. The first antenna unit 280 converts the amplified millimeter-wave signal to an electromagnetic wave, and sends out the electromagnetic wave into millimeter-wave wireless communication path in the free space.

The monitor unit 100 includes a demodulation circuit 150, a second frequency conversion circuit 160, an amplifier 170, and a second antenna unit 180. The electromagnetic wave sent out from the first antenna unit 280 is received at the second antenna unit 180 through the millimeter-wave wireless communication path in free space.

The received electromagnetic wave is converted to the millimeter-wave signal by the second antenna unit 180 and is amplified by the amplifier 170. The amplified millimeter-wave signal is frequency-converted by the second frequency conversion circuit 160, and is then demodulated by the demodulation circuit 150 to form an output signal which may be supplied therefrom. Video data of the demodulated signal is displayed on the display 105, and audio data of the demodulated signal is output from the loudspeaker not shown.

Functions of the first frequency conversion circuit 260 and the amplifier 270 are a function of the millimeter-wave communication module 210. Functions of the second frequency conversion circuit 160 and the amplifier 170 are a function of the millimeter-wave communication module 110.

(Wired Transmission Line 300)

On the other hand, when the millimeter-wave wireless communication path cannot be ensured in the free space, video data and audio data are transmitted to the monitor unit 100 from the set-top box 200 using the wired transmission line 300, as shown in FIGS. 1 and 4.

In this case as well, when an input signal is supplied to the modulation circuit 250, the modulation circuit 250 modulates the input signal. The modulated signal is frequency-converted by the first frequency conversion circuit 260. A millimeter-wave signal is thereby generated. The millimeter-wave signal is amplified by the amplifier 270. The functions of the first frequency conversion circuit 260 and the amplifier 270 are included in functions of the millimeter-wave communication module 210.

The millimeter-wave signal sent out from the millimeter-wave communication module 210 passes through the exterior resin of the housing of the set-top box 200, and is guided to the second coupling unit 320. As described before, the second coupling unit 320 is installed in such a manner that the second coupling unit 320 overhangs immediately above the antenna of the millimeter-wave communication module. Leakage of an electromagnetic wave to be radiated to the outside may be thereby suppressed.

In this embodiment, the second coupling unit 320 has a shape of a horn antenna, like the first coupling unit 310 shown in FIG. 2. The electromagnetic wave supplied to the second coupling unit 320 is therefore guided to its narrowed-down side, and is then introduced into the waveguide 330. When sectional shapes of the second coupling unit 320 having the shape of the horn antenna and the waveguide 330 are different, mode conversion of the electromagnetic wave is performed at the second conversion unit, for coupling.

The electromagnetic wave guided into the waveguide 330 from the second coupling unit 320 is guided to the first coupling unit 310 as the other side device through the waveguide 330. At the time of guiding, the electromagnetic wave is mode-converted by the first conversion unit, radiated onto the housing from the first coupling unit 310, passes through the exterior resin of the housing of the monitor unit 100, and is guided to the millimeter-wave communication module 110. The functions of the second frequency conversion circuit 160 and the amplifier 170 are included in functions of the millimeter-wave communication module 110.

The received millimeter-wave signal is amplified by the amplifier 170. The amplified millimeter-wave signal is frequency-converted by the second frequency conversion circuit 160, and is then demodulated by the demodulation circuit 150 and outputted therefrom as an output signal. Video data of the demodulated signal is displayed onto the display 105, while audio data of the demodulated signal is output from the loudspeaker not shown.

Preferably, the waveguide 330 may be bent as freely as possible in view of handling easiness. However, generally, when the waveguide 330 is bent, noncontinuity of the sectional shape of the waveguide occurs. Thus, a characteristic impedance of the waveguide 330 is changed such that signal reflection may occur. This may bring about deterioration of quality of a high-speed signal. However, the millimeter-wave communication module premised on free space transmission is designed for modulation so that a communication operation is possible even in a multi-path environment. For this reason, even if the signal reflection occurs at the waveguide 330 and the respective coupling units 310 and 320, demodulation may be performed without a problem.

As described above, according to the wired transmission line 300 for the AV devices in this embodiment, the wired transmission line which allows millimeter-wave communication between the monitor unit 100 and the set-top box 200 that constitute the TV set 10 may be ensured, even if it is difficult to ensure the millimeter-wave communication path in free space. With this arrangement, stable transmission of video data and audio data is allowed, irrespective of the surrounding environment.

According to the wired transmission line 300 for the AV devices in this embodiment, it is not necessary to disconnect a connection with the antenna so as to switch a connection to the waveguide such as the coaxial line. Shortest routing may be therefore performed between the antenna and the wireless device so that optimum performance may be exhibited.

When compared with a wired connection method using an HDMI cable or the like, an HDMI transmitter, an HDMI receiver, and a circuit component to be added for switching a video signal are not needed. For this reason, cost reduction of and reduction in the size of the AV device may be implemented.

According to the wired transmission line 300 for the AV devices in this embodiment, radiation of the electromagnetic wave around the AV devices from each of the antennas of the millimeter-wave communication module 110 and the millimeter-wave communication module 210 included in the AV devices may be suppressed by the first coupling unit 310 and the second coupling unit 320. This may efficiently guide the electromagnetic wave to only the AV device targeted for communication. Accordingly, even if the number of frequency channels is limited, the plurality of devices may be simultaneously operated without causing interference.

2. Variation Example: Coupling Unit

Next, first and second variation examples of the coupling unit in this embodiment will be described with reference to FIGS. 5 and 6. Since a first coupling unit 310 and a second coupling unit 320 have the same shape, a description will be herein given, taking the first coupling unit 310 as an example.

[2-1. First Variation Example of Coupling Unit]

Figure 5:
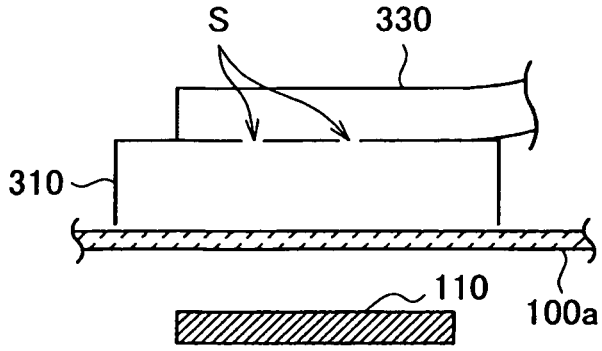
FIG. 5 is a diagram showing a hardware configuration of a coupling unit in a first variation example.

As shown in FIG. 5, the first coupling unit 310 in the first variation example is shaped like a box and is formed of metal. The first coupling unit 310 is installed in such a manner that the first coupling unit 310 overhangs the millimeter-wave communication module 110 immediately above the millimeter-wave communication module 110. A waveguide 330 has a rectangular section, which means that the waveguide 330 is a rectangular waveguide. One or more slots S (openings) are provided in a coupling portion between the first coupling unit 310 and the waveguide 330. One or more slots S are provided in a coupling portion between the waveguide 330 and the second coupling unit located at a terminating end portion of the waveguide 330 opposite to the first coupling unit 310, as well.

When a wired transmission line 300 for the AV devices is formed of a combination of the box-like first coupling unit 310, the box-like second coupling unit 320, and the rectangular waveguide, a millimeter-wave signal is guided from each of the first coupling unit 310 and the second coupling unit 320 into the waveguide through the one or more slots S.

[2-2. Second Variation Example of Coupling Unit]

Figure 6:
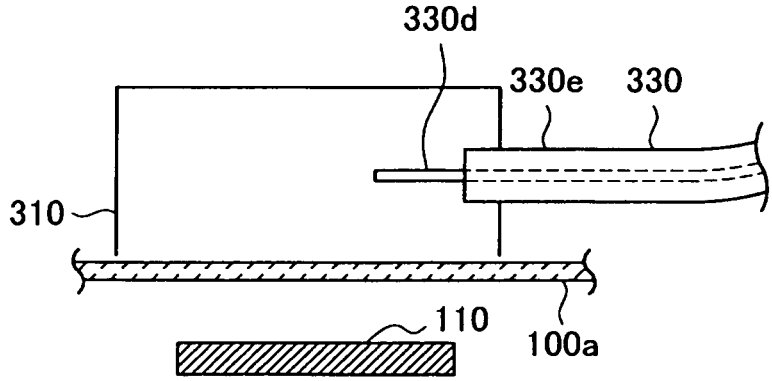
FIG. 6 is a diagram showing a hardware configuration of a coupling unit in a second variation example.

As shown in FIG. 6, the first coupling unit 310 in the second variation example is shaped like a box and is formed of metal. The first coupling unit 310 is installed in such a manner that the first coupling unit 310 overhangs the millimeter-wave communication module 110 immediately above the millimeter-wave communication module 110. A waveguide 330 is a coaxial line in which an internal conductor 330*d* and an external conductor 330*e* are concentrically disposed. A space between the internal conductor 330*d* and the external conductor 330*e* may be hollow, or may be filled with a dielectric. The internal conductor 330*d* of the coaxial line (waveguide 330) is pulled out from both ends of the coaxial line by a length corresponding to a frequency for use, and is exposed (projected) into an internal space of each of the first coupling unit 310 and the second coupling unit 320.

When a wired transmission line 300 for the AD devices is formed by a combination of the box-shaped coupling units and the coaxial line as in the second variation example, only a core portion (internal conductor 330*d*) of the coaxial line is pulled out into each of the first coupling unit 310 and the second coupling unit 320 only by the length corresponding to the frequency for use. With this arrangement, the core portion may serve as an antenna, may guide a millimeter wave from the second coupling unit 320 to the waveguide 330, and further may guide the millimeter wave from the waveguide 330 to the first coupling unit 310.

3. Variation Example: Waveguide

Figure 7:
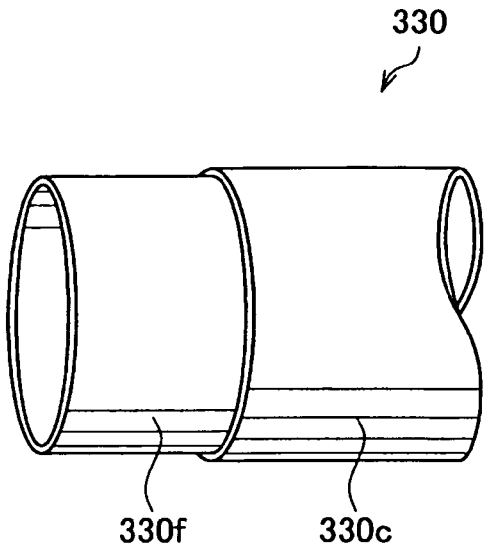
FIG. 7 is a diagram showing a hardware configuration of a waveguide in a third variation example.
Figure 8:
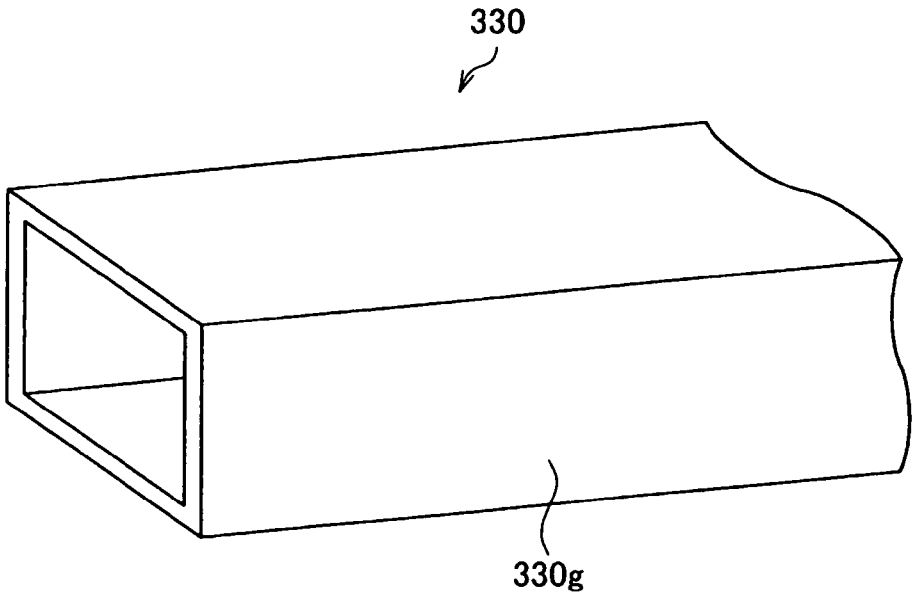
FIG. 8 is a diagram showing a hardware configuration of a waveguide in a fourth variation example.

Next, third to fifth variation examples of the waveguide in this embodiment will be described with reference to FIGS. 7 to 9.

[3-1. Third Variation Example of Waveguide>

An annular metal member is provided for a waveguide 330 in the third variation example. As an example of the annular metal member, a metal pipe 330*f* with a circular section is used, as shown in FIG. 7. The metal pipe 330*f* is covered with a protective film 330*c*.

[3-2. Fourth Variation Example of Waveguide]

In the first embodiment and the third variation example, the waveguide 330, which is a circular waveguide, was taken as an example. The waveguide is not limited to this configuration. As shown in the fifth variation example in FIG. 8, a waveguide 330 may be constituted from a rectangular waveguide 330*g* formed of a metal member and having a rectangular section.

[3-3. Fifth Variation Example of Waveguide]

Figure 9:
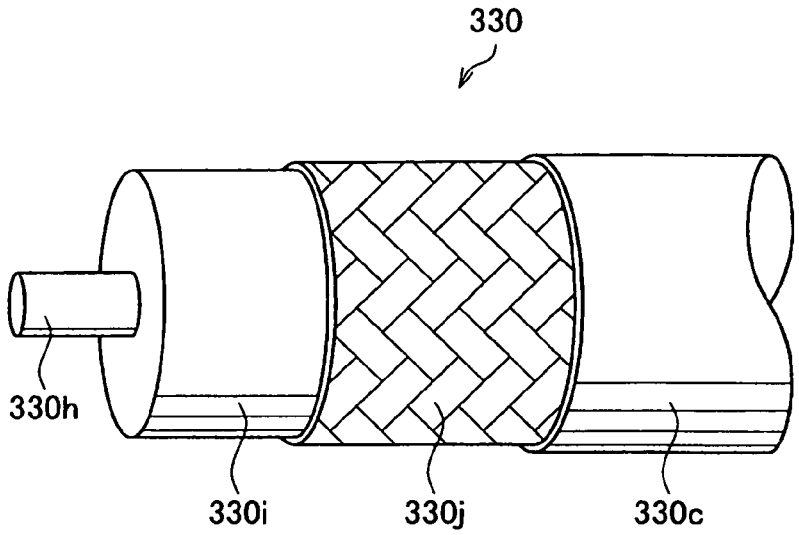
FIG. 9 is a diagram showing a hardware configuration of a waveguide in a fifth variation example.

Alternatively, as shown in the fifth variation example shown in FIG. 9, a waveguide 330 may include a coaxial line in which an internal conductor 330*h* and an external conductor 330*j* are concentrically disposed and the external conductor 330*j* is a mesh-braided conductor. A dielectric 330*i* is filled between the internal conductor 330*h* and the external conductor 330*j*. The outside of the external conductor 330*j* is covered with a protective film 330*c*.

As described above, even if it is difficult to ensure a millimeter-wave communication path in a free space, millimeter-wave communication is allowed between the AV devices by the coupling units and the waveguide in each of the variation examples.

The above-mentioned coupling unit in each variation example, the above-mentioned waveguide in each variation example, and the coupling units and the waveguide shown in the first embodiment may be freely combined to form a wired transmission line 300 for the AV devices. Even if an environment for millimeter-wave wireless communication is not ideal, millimeter-wave communication between the AV devices is allowed by any one of these combinations.

As described above, according to the first embodiment and each variation example, by providing the wired-type of waveguide for the separate-type TV set, video and audio transmission is allowed even if a millimeter-wave wireless communication channel cannot be ensured in free space. Further, by passing the electromagnetic wave into the wired-type of waveguide, radiation of the millimeter wave outside of the waveguide may be suppressed, and interference among surrounding millimeter-wave wireless communication devices may be reduced.

Especially when the waveguide 330 has a configuration of the coaxial line in which the external conductor is the mesh-braided conductor or a configuration in which the cylindrical dielectric is covered with the mesh-braided conductor, the waveguide 330 is easy to bend. Accordingly, the waveguide 330 may be bent to a certain extent. Then, even if the first coupling unit 310 and the second coupling unit 320 are coupled while bending the waveguide 330, the millimeter wave may scarcely leak outside of the waveguide.

In the embodiment and each variation example described above, operations of the respective units are associated with one another and may be replaced with a sequence of operations and a sequence of processes, with the mutual association being taken into consideration. The embodiment of the wired transmission line may be thereby regarded as an embodiment of a wireless transmission method.

With this arrangement, there may be provided a wired transmission method for AV devices comprising a first AV device, a second AV device, and a wired transmission line to perform millimeter-wave communication between the first AV device and the second AV device using a millimeter-wave communication module provided for each of the first AV device and the second AV device through the wired transmission line, the wired transmission method including the steps of: sending out a millimeter wave from the millimeter-wave communication module of the first AV device to a first coupling unit attached to a housing of the first AV device above the millimeter-wave communication module of the first AV device; transmitting the millimeter wave from the first coupling unit to a waveguide coupled to the first coupling unit; and transmitting the millimeter wave from the waveguide coupled to a second coupling unit to the second coupling unit above the millimeter-wave communication module of the second AV device, the second coupling unit being attached to a housing of the second AV device.

It should be understood by those skilled in the art that various modifications, combinations, sub-combinations and alterations may occur depending on design requirements and other factors insofar as they are within the scope of the appended claims or the equivalents thereof.

In the above-mentioned embodiment, description was given, taking the TV set where the set-top box and the monitor unit are separately provided, as an example. The present invention is not limited to such an example. The wired transmission line for AV devices of the present invention may also be used for AV data communication between devices using a home LAN (home network) in particular, for example, based on DLNA (Digital Living Network Alliance: registered trademark) technical specifications.

What is claimed is:

1. A wired transmission line for AV devices comprising a first AV device and a second AV device, the wired transmission line allowing millimeter-wave communication between the first AV device and the second AV device using first and second millimeter-wave communication modules respectively provided for each of the first AV device and the second AV device, wherein the wired transmission line comprises:

a first coupling unit capable of being attached to a housing of the first AV device above the first millimeter-wave communication module included in the first AV device;

a second coupling unit capable of being attached to a housing of the second AV device above the second millimeter-wave communication module included in the second AV device; and a waveguide which couples the first coupling unit and the second coupling unit, wherein the first coupling unit and the second coupling unit are respectively attached to the housings of the first AV device and the second AV device so as to overhang the millimeter-wave communication modules.

2. The wired transmission line for AV devices according to claim 1, wherein each of the first coupling unit and the second coupling unit is shaped like a horn antenna;

a first conversion unit which converts a mode of a millimeter wave is provided at a coupling portion between the first coupling unit and the waveguide; and a second conversion unit which converts the mode of the millimeter wave is provided at a coupling portion between the second coupling unit and the waveguide.

3. The wired transmission line for AV devices according to claim 1, wherein each of the first coupling unit and the second coupling unit is shaped like a box;

the waveguide has a rectangular section; and one or more slots are provided in a first coupling portion between the first coupling unit and the waveguide and a second coupling portion between the second coupling unit and the waveguide.

4. The wired transmission line for AV devices according to claim 1, wherein the waveguide is a coaxial line in which an internal conductor and an external conductor are concentrically disposed, and the external conductor has a shape of a mesh-braided conductor.

5. The wired transmission line for AV devices according to claim 4, wherein the internal conductor at one end portion of the coaxial line projects into a first internal space of the first coupling unit at a first coupling portion between the first coupling unit and the coaxial line; and the internal conductor at the other end portion of the coaxial line projects into a second internal space of the second coupling unit at a second coupling portion between the second coupling unit and the coaxial line.

6. The wired transmission line for AV devices according to claim 1, wherein the waveguide has a configuration in which a cylindrical dielectric is covered with a mesh-braided conductor.

7. The wired transmission line for AV devices according to claim 1, wherein the waveguide has an annular metal member.

8. The wired transmission line for AV devices according to claim 1, wherein the waveguide is a rectangular waveguide formed of a metal member.

9. A wired transmission method for AV devices comprising a first AV device, a second AV device, and a wired transmission line to perform millimeter-wave communication using first and second millimeter-wave communication modules respectively provided for each of the first AV device and the second AV device through the wired transmission line, the wired transmission method comprising:

sending out a millimeter wave from the first millimeter-wave communication module of the first AV device to a first coupling unit attached to a housing of the first AV device above the first millimeter-wave communication module of the first AV device;

transmitting the millimeter wave from the first coupling unit to the wired transmission line coupled to the first coupling unit; and transmitting the millimeter wave from the wired transmission line to a second coupling unit attached to a housing of the second AV device above the second millimeter-wave communication module of the second AV device, wherein the first coupling unit and the second coupling unit are respectively attached to the housings of the first AV device and the second AV device so as to overhang the corresponding ones of the first and second millimeter-wave communication modules.

* * * * *